US011825889B2

(12) United States Patent
Quiroga et al.

(10) Patent No.: US 11,825,889 B2
(45) **Date of Patent: *Nov. 28, 2023**

(54) MEDICAL GARMENT FOR CHEST DEVICES AND PROCEDURES

(71) Applicant: The Emilio Nares Foundation, San Diego, CA (US)

(72) Inventors: Luz A. Quiroga, Chula Vista, CA (US); Corina Elizabeth Quiroga Banzer, La Paz (BO)

(73) Assignee: The Emilio Nares Foundation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/990,215

(22) Filed: Nov. 18, 2022

(65) Prior Publication Data

US 2023/0085316 A1 Mar. 16, 2023

Related U.S. Application Data

(63) Continuation of application No. 16/996,803, filed on Aug. 18, 2020, now Pat. No. 11,528,948, which is a (Continued)

(51) Int. Cl.
*A41D 13/12* (2006.01)

(52) U.S. Cl.
CPC ..... *A41D 13/129* (2013.01); *A41D 13/1245* (2013.01)

(58) Field of Classification Search
CPC ..... A41D 13/1245; A41D 13/129; A41D 13/1272; A41D 13/1236; A41D 1/215
See application file for complete search history.

(56) References Cited

U.S. PATENT DOCUMENTS 302,901 A * 8/1884 Fenne ..... A41D 13/1236 2/114
818,351 A 4/1906 Clark
(Continued)

OTHER PUBLICATIONS

Baby Gap; bodysuit with snap shoulders; http://gap.com/browse/product.do?

(Continued)

*Primary Examiner* — Jillian K Pierorazio

(57) ABSTRACT

Embodiments of the disclosure include a medical garment that resembles a shirt. The medical garment includes a body that includes a front portion attached to a back portion by one or more non-partable seams. The medical garment includes first and second sleeves on opposite sides of the medical garment. The first and second sleeves are coupled to the front portion and the back portion of the medical garment. The medical garment includes a partable seam having a zippered opening formed in the medical garment that extends from a collar area of the medical garment toward a bottom part of one of the sleeves where the sleeve attaches to the body. The partable seam also includes a zipper to close the zippered opening and hold the zippered opening in a closed position. The medical garment is configured to expose the patient's chest area when the zippered opening is in an open position, and resembles a standard shirt when the zippered opening is in the closed position.

19 Claims, 3 Drawing Sheets

Related U.S. Application Data continuation of application No. 15/885,605, filed on Jan. 31, 2018, now Pat. No. 10,779,590, which is a continuation of application No. 13/363,104, filed on Jan. 31, 2012, now Pat. No. 9,901,129.

(56) References Cited

U.S. PATENT DOCUMENTS 1,386,950 A * 8/1921 Rifkin ..... A41D 13/02 D2/714
1,489,046 A * 4/1924 Thompson ..... A41B 9/08 2/269
1,998,051 A * 4/1935 Gerber ..... A41D 13/1236 2/114
2,341,797 A 2/1944 Murray
2,428,198 A * 9/1947 Brohard, Jr. ..... A41D 1/02 2/96
2,523,175 A * 9/1950 Yates ..... A41B 1/10 2/128
2,582,811 A * 1/1952 Williams ..... A41D 13/012 2/82
2,722,686 A 11/1955 Hoskings
3,276,036 A * 10/1966 Cater ..... A41D 13/1245 2/114
3,611,439 A * 10/1971 Meyers ..... A41D 1/215 2/104
4,004,294 A * 1/1977 Pinch ..... A41D 1/215 2/104
4,031,566 A * 6/1977 Johnson ..... A41D 1/215 2/104
4,144,593 A * 3/1979 Timmons ..... A41D 1/215 2/104
4,208,743 A * 6/1980 Whitcraft ..... A41D 1/215 2/104
4,434,511 A * 3/1984 Weiser ..... A41D 13/1236 2/114
4,446,572 A * 5/1984 Lindquist ..... A41D 1/215 2/104
4,547,907 A 10/1985 Netsky
4,570,268 A 2/1986 Freeman
4,578,062 A 3/1986 Schneider
4,718,124 A * 1/1988 Sawicki ..... A41D 13/129 2/114
4,764,986 A * 8/1988 Stewart ..... A41D 13/129 2/135
4,920,578 A * 5/1990 Janzen ..... A41D 13/129 2/114
5,048,122 A * 9/1991 Prieur ..... A41D 13/1272 2/80
5,062,159 A 11/1991 Jakub
5,133,086 A * 7/1992 Truitt ..... A41D 13/1236 2/105
5,392,466 A 2/1995 Chou et al.
5,440,763 A * 8/1995 Shah ..... A41D 13/1236 2/912
5,611,087 A * 3/1997 Adkins ..... A41D 13/1236 2/919
5,621,917 A * 4/1997 Howsden ..... A41B 13/06 2/114
5,727,256 A * 3/1998 Rudman ..... A41D 27/28 2/DIG. 2
5,799,330 A * 9/1998 O'Donoghue-Kitt ..... A41D 13/1236 2/908
5,829,059 A * 11/1998 Covington, Jr. ... A41D 13/1263 2/69
D414,015 S * 9/1999 Small ..... D2/847
6,032,287 A * 3/2000 Kallas ..... A41D 15/00 2/74
6,216,271 B1 4/2001 Chen
6,450,168 B1 * 9/2002 Nguyen ..... A61B 5/6805 128/877
6,647,552 B1 * 11/2003 Hogan ..... A41D 13/1245 2/114
6,973,673 B2 12/2005 Beuk
7,010,812 B1 * 3/2006 Cho ..... A41D 13/1245 2/104
7,073,204 B1 * 7/2006 Boyles ..... A41D 13/1236 2/114
7,181,773 B1 * 2/2007 Piraka ..... A41D 13/1281 2/114
7,350,239 B1 4/2008 Rosenzweig
7,454,798 B2 11/2008 Feodoroff
D584,483 S 1/2009 Glynn
7,810,171 B2 * 10/2010 Moore ..... A41D 1/215 2/104
7,810,172 B2 * 10/2010 Williams ..... A41D 13/1236 2/114
7,987,524 B2 * 8/2011 Bower ..... A41D 13/1245 2/114
2001/0039672 A1 * 11/2001 Force ..... A41D 1/215 2/104
2003/0126668 A1 * 7/2003 Scroggins ..... A41D 13/1236 2/114
2004/0166766 A1 * 8/2004 Schneider ..... A41D 1/215 450/36
2005/0010988 A1 * 1/2005 Ragot ..... A41D 13/012 2/2.15
2005/0028241 A1 * 2/2005 Ragot ..... B63C 11/04 2/69
2006/0031976 A1 * 2/2006 Nwawka ..... A41D 13/1245 2/114
2006/0143778 A1 * 7/2006 Shak ..... A41D 7/008 2/114
2007/0245450 A1 * 10/2007 Feodoroff ..... A41D 13/1254 2/114
2008/0115255 A1 * 5/2008 Gorman ..... A41D 13/1263 2/114
2009/0000008 A1 * 1/2009 Moore ..... A41D 1/215 2/104
2009/0100569 A1 * 4/2009 Butler ..... A41F 1/00 2/114
2010/0251456 A1 10/2010 Bower
2010/0299803 A1 * 12/2010 Ladra ..... A41D 13/1245 2/114
2012/0005803 A1 * 1/2012 Sagami ..... A41D 13/1245 2/114
2012/0078190 A1 * 3/2012 Austin ..... A61M 25/02 2/300
2012/0137400 A1 * 6/2012 Farris ..... A41D 13/1245 2/114
2013/0067633 A1 * 3/2013 Salem ..... A41D 13/1245 2/102
2014/0157479 A1 * 6/2014 Streep ..... A41D 13/1245 2/69
2015/0374048 A1 * 12/2015 Theodossiou ..... A41D 13/1245 2/114

OTHER PUBLICATIONS

"Hudson Baby Premium Shoulder Snap Bodysuit Girls' Extended Family, Loved by Grandma—Newborn", Aug. 2009, Retrieved from URL [www.amazon.sg_Fashion] Apr. 20, 2020.

* cited by examiner

MEDICAL GARMENT FOR CHEST DEVICES AND PROCEDURES

CROSS-REFERENCE TO RELATED APPLICATIONS

This application is a continuation of and claims priority to U.S. patent application Ser. No. 16/996,803, filed Aug. 18, 2020, which claims priority to U.S. patent application Ser. No. 15/885,605, filed Jan. 31, 2018, and issued as U.S. Pat. No. 10,779,590, which claims priority to U.S. patent application Ser. No. 13/363,104, filed Jan. 31, 2012, and issued as U.S. Pat. No. 9,901,129, the contents of which are incorporated herein by reference in their entirety.

FIELD OF THE INVENTION

The present invention relates generally to medical garments. More specifically, the present invention relates to a medical garment designed to outwardly resemble a standard t-shirt, while providing easy access to medical devices attached to the wearer's chest.

DISCUSSION OF THE RELATED ART

For patients receiving certain medical treatments, it is often necessary to remove clothing to expose body areas for receiving treatment, connect medical devices, or allow access to such medical devices. Many people have aversions to disrobing and wearing hospital medical gowns, often with the feeling that their bodies are prone to unnecessary exposure due to the way the garments are constructed. Others feel that changing into a medical gown is inconvenient and unnecessary when receiving a quick medical procedure. This can be particularly troublesome with young children, as they often will resist multiple changes of clothes or any clothing that is deemed uncomfortable.

For instance, U.S. Pat. No. 7,454,798 to Feodoroff relates to a medical garment configured to be worn by a patient requiring medical attention. The application discloses a blouse portion, a shoulder portion, a torso portion, two arm portions, an open front, and at least one fastener; a breast access panel separate from the open front and extending from the shoulder portion to the waist of the patient, a strip of hook and loop material attached to an inside of the breast access panel; a mating strip of hook and loop material attached to an outside of the torso portion, wherein the breast access panel is configured to be moved between ins open and closed positions while maintaining the open front in its closed position. The configuration of the breast access panel provides much too large of an access area to the wearer's chest.

U.S. Pat. No. 6,647,552 to Hogan discloses a medical dignity garment allowing access to a medical access area of the patient without removal of the garment and closure over the garment while treatment is in progress, comprising a body portion, and front panels having at least one flap, the flap defined by placket, lower, sleeve, and folding edges. The flap can be folded along the folding edge. Due to the configuration of openable edges, the way that the flap opens is not ideal for procedures on the chest area from above in comparison to the present disclosure.

SUMMARY

Thus comes the need for a medical garment that allows a patient to wear the garment in or out of the hospital, while still providing access to the areas needed to receive medical treatment when necessary.

The present embodiments seek to solve problems present in the prior art, including, for example, that many medical garments are not suited to casual wear, and medical garments with access means to the wearer's body often expose a larger area than required, or provide access in such a way that is incompatible with comfortable routing of medical devices or components being used in certain treatments. Such a garment optionally should not resemble a medical garment so that it may be worn casually, and be comfortable to wear when sitting, standing, or laying down.

One aspect of the present embodiments is directed to a medical garment outwardly resembling a t-shirt, adapted to be worn by a person requiring medical attention. The medical garment may include a first and second sleeve and a body with a front portion and a back portion connected by one or more non-partable seams. The first and second sleeves may be coupled to the front portion and the back portion. When the medical garment is worn by a person, the first and second sleeves may be configured to extend to about the person's elbows or wrists and the medical garment may be configured to extend down to about the person's waist. Further, when the medical garment is worn, other than one or more zippered openings configured to open to expose an area of the person's upper torso the medical garment is substantially free of openings that would expose the upper torso. The zippered opening may be opened and closed by zippers affixed on a portion of the zippered opening itself between a collar or chest area towards a sleeve.

The front portion of the body may include a partable seam that includes a zippered opening that extends from a collar area of the medical garment away from the collar area toward a bottom part of the first or second sleeve where the first or second sleeve attaches to the body. The zippered opening may extend from a first collar area of the medical garment towards a first sleeve. In one or more embodiments, when the zippered opening is in an open position, an area of the person's torso is exposed, and when the zippered opening is in the closed position, the area of the person's torso is covered. When open, the zippered opening may allow for a medical device to be passed therethrough and allow for access to medical devices embedded in the person's torso. The zippered opening may be disposed on the medical garment in a location proximate to a location where the medical devices enters the person's body. The zippered opening may be disposed on the medical garment in a location proximate to a chest area of the garment and the chest area of the medical garment may be disposed on a chest area of the person when the medical garment is worn. The partable seam may also include a zipper to close the zippered opening of the partable seam and hold the partable seam in a closed position. In one or more embodiments, a second zippered opening may extend from the collar area on a different portion of the front portion of the body away from the collar toward a bottom part of the second sleeve where the second sleeve attaches to the body.

One embodiment may include a medical garment that includes a zippered opening that provides access to a wearer's chest without having to remove the medical garment.

Another aspect of the present embodiments is directed to a medical garment outwardly resembling a t-shirt, adapted to be worn by a person requiring medical attention. The medical garment includes first and second sleeves and a body with a front portion and a back portion connected by one or more non-partable seams. The first and second sleeves are coupled to the front portion and the back portion. When the medical garment it worn by a person, the first and second sleeves are configured to extend to about the person's elbows or wrists and the medical garment is configured to extend down to about the person's waist. Further, when the medical garment is worn, other than one or more zippered openings configured to open to expose an area of the person's torso the medical garment is substantially free of openings that would expose the torso. The front portion of the body includes a partable seam that includes a zippered opening that extends from a center area of the front portion laterally toward a part of the first or second sleeve where the first or second sleeve attaches to the body. The zippered opening may extend from a first center area of the front portion towards a first sleeve. In one or more embodiments, when the zippered opening is in an open position, an area of the person's torso is exposed, and when the zippered opening is in the closed position, the area of the person's torso is covered. When open, the zippered opening may allow for a medical device to be passed therethrough. The zippered opening may be disposed on the medical garment in a location proximate to a location where the medical devices enters the person's body. The zippered opening may be disposed on the medical garment in a location proximate to a chest area of the garment and the chest area of the medical garment may be disposed on a chest area of the person when the medical garment is worn. The zippered opening also includes a zipper to close the zippered opening of the zippered opening and hold the zippered opening in a closed position. In one or more embodiments, a second zippered opening extends from the center area on a different portion of the front portion of the body laterally toward a bottom part of the second sleeve where the second sleeve attaches to the body.

Another aspect of the present embodiments is directed to a garment including a body with a front portion and a back portion. The garment may include a sleeve coupled to the front portion by at least a portion of the a partable seam, and the back portion by at least a portion of a non-partable seam. There may be a collar at a top portion of the body, where the collar defines an opening and has a perimeter, such that a top partable seam extends from the opening along a shoulder region at or near the top portion of the body and further extends from the shoulder region down along a sleeve adjacent region of the front portion, toward a bottom portion of the body. The garment may have one or more fasteners configured to hold the partable seam and top partable seam in a closed position and be configured to release the partable seam and the top partable seam into an open position such that the partable seam and top partable seam at least partially define a flap. The flap may be configured to open from the collar to the shoulder region, where the flap extends from the collar at least along a top portion of the body toward the bottom portion of the body, wherein no other partable seam defines the flap, and where the flap is configured to open at the perimeter of the collar at the top portion of the body. The flap may be configured to fold outwards and downwards to expose the upper torso of the person. The medical garment can further include a fastener to hold the partable seam in a closed position. The fastener may be any one of or a combination of a hook-and-loop type fastener, a button, a clip, a zipper, and a clasp. The sleeve may be configured to, when the garment is worn, extend to about the person's elbow or wrist and at least partially surround the person's arm. In some embodiments, the areas where the flap overlaps the back portion and the sleeve portion, and where the fasteners are attached, are reinforced to withstand numerous openings and closings of the flap. The reinforcements to the areas may optionally be done by folding over of fabric from the respective back or sleeve portions and sewing the folded fabric into place, by the addition of strips of fabric or other material sewn into the areas, or by embedding additional fabric or other material into the overlap areas. The bottom portion of the body may be configured to extend to about the person's waist, where when the partable seam and the top partable seam are in in the open position the flap is configured to expose a portion of the person's torso. Other than the flap the garment has no more than one other flap for exposing an upper torso or arm of the person.

Another embodiment can be characterized as a medical garment that includes a front portion attached to a back portion. The front and back portions may have an inside surface and an outside surface, and a collar located at the top of the front portion and the back portion. The collar may be configured to surround a neck of a person. The collar may also have a first and second shoulder region on each side of the collar. The shoulder regions may be adapted to surround the shoulders of the person wearing the garment and have proximal and distal ends in relation to the collar. The sleeves may be affixed to the front and the back portions and configured to surround at least a portion of an arm of the person. The sleeves may also have a top and a bottom, and proximal and distal ends in respect to the collar opening. The medical garment may further include a partable seam or zippered opening that extends from a collar or center area of the medical garment away from the collar area toward a bottom part of the first or second sleeve where the first or second sleeve attaches to the body. The partable seam may be configured to open and close to expose a portion of the upper torso of the person when in an open position. In some embodiments, the partable seam or zippered opening may include zippers to hold the partable seam or zippered opening in the closed position.

BRIEF DESCRIPTION OF THE DRAWINGS

The above and other aspects, features and advantages of the present invention will be more apparent from the following more particular description thereof, presented in conjunction with the following drawings, wherein.

Figure 1:
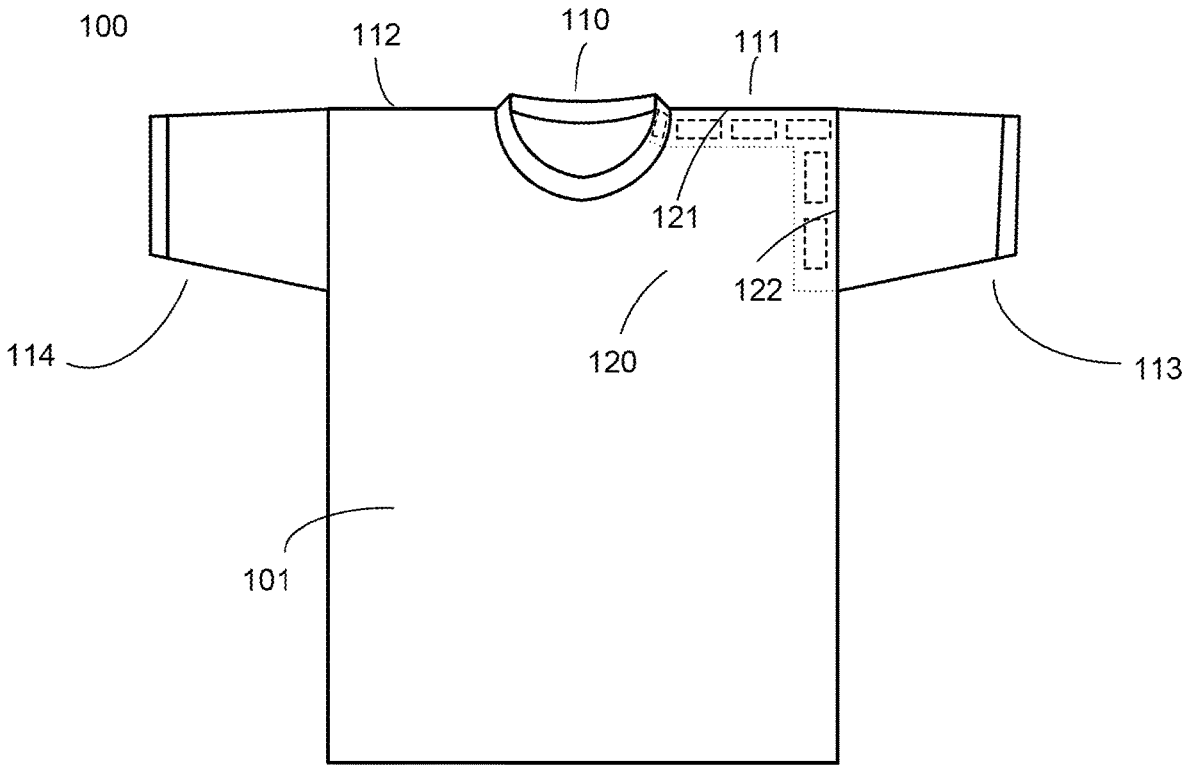
FIG. 1 shows a front view of a medical garment with the outward appearance resembling a standard t-shirt in accordance with one embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION

The following description is not to be taken in a limiting sense, but is made merely for the purpose of describing the general principles of the invention. The scope of the invention should be determined with reference to the claims. The present embodiments address the problems described in the background while also addressing other additional problems as will be seen from the following detailed description.

Referring to FIG. 1, shown is a front view of a medical garment 100 with the outward appearance resembling a standard t-shirt in accordance with one embodiment. A body including a front portion 101 is shown, with a collar 110 configured to surround the wearer's neck at the top of the front portion 101. Adjacent to the collar 110 on each side are a first shoulder region 111 and a second shoulder region 112. On the sides of the front portion 101, a first sleeve 113 and a second sleeve 114 are attached, which are configured to surround the wearer's arms. A flap 120 in the closed position is located at the first shoulder region 111 and adjacent to the first sleeve 113. The flap 120 is positioned such that a portion of the chest area of the wearer is exposed when the flap 120 is in the open position. A first partable seam 121 is formed on the front portion 101, extending from the collar 110 and along the first shoulder region 111 to the top of the first sleeve 113. A second partable seam 122 is also formed on the front portion 101 and located at the proximal end of the first sleeve 113 and extends from the top to the bottom of the first sleeve 113. In this configuration, the flap 120 opens at the first partable seam 121 and the second partable 122 to expose the left side of the wearer's chest to provide access for medical personnel. Alternatively, the flap 120 may be positioned for access to the right side of the wearer's chest by locating the first partable seam at the second shoulder region 112 and the second partable seam at the second sleeve 114.

The configuration of the flap 120 and first and second partable seams 121 and 122 provide the benefit of easy access to medical devices used on the wearer's chest area while allowing the wearer to keep wearing the garment. Particularly, the orientation of flap 120 provides benefits in the use of central venous catheters ("CVC") such as tunneled catheters or implanted ports (port-a-caths), which are used in chemotherapy treatments or other procedures. These types of CVC devices are implanted into patients and designed to provide ready access to administer medication or fluids, draw blood, or directly obtain cardiovascular measurements, thus eliminating the need for constant needle pricks. CVCs generally comprise an access port and line that enters at a point near or on the wearer's chest and tunnels under the skin, with the exit portion inserted into a blood vessel near the wearer's heart, typically the subclavian vein or the superior vena cava. These types of devices are designed to remain in place for long periods of time, on the order of months to years, and require some type of routine maintenance during its use to prevent infection and thrombosis. The flap 120 can be opened to allow access to catheter lines and other attachments for such medical procedures or maintenance. Further, the orientation of the flap 120 and the first partable seam 121 and second partable seam 122 allow for access to the wearer's chest while the wearer is sitting down (i.e., access from above) or while laying down.

Figure 2:
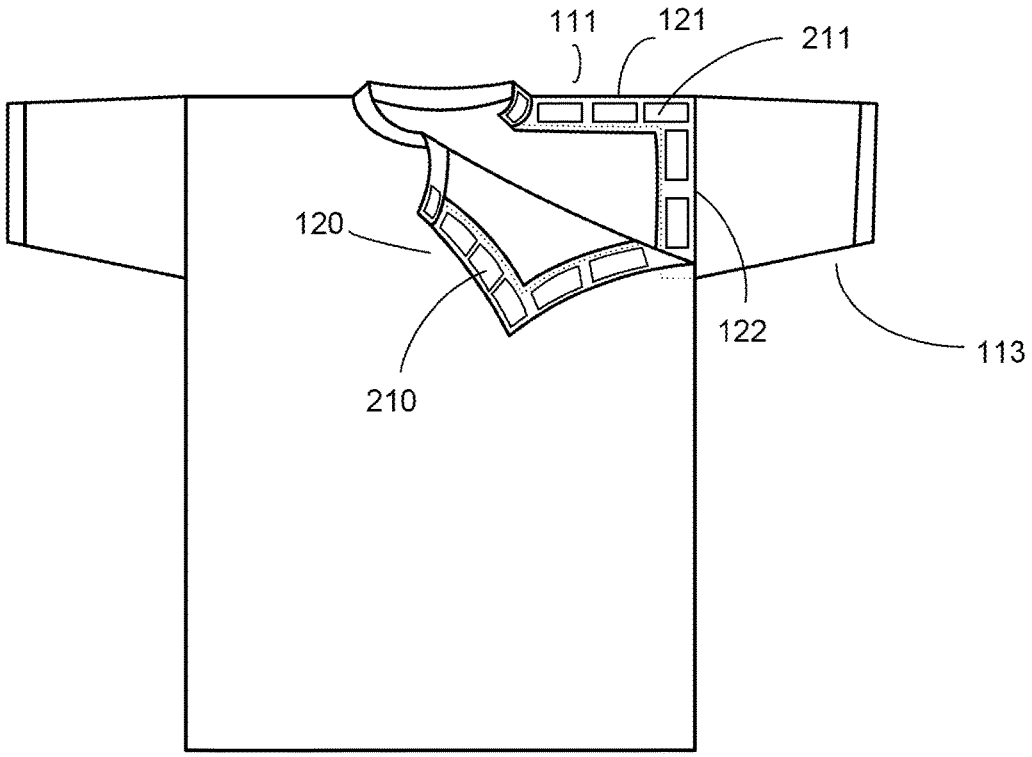
FIG. 2 shows a front view of the medical garment of FIG. 1, with a flap in the open position.

Referring to FIG. 2, shown is a front view of the medical garment 100 of FIG. 1, with the flap 120 in the open position, partially revealing an inside surface of a back portion 301. The flap 120 is opened at the first partable seam 121 and second partable seam 122, with a plurality of fasteners 210 attached to the inside surface of the flap 120 and a plurality of opposing fasteners 211 attached to the back portion 301 at the first partable seam 121 and the first sleeve 113 at the second partable seam 122. As can be seen, the flap 120 opens to expose a portion of the wearer's chest while keeping the rest of the wearer's torso covered. The configuration of the first partable seam 121 and second partable seam 122 along the first shoulder region 111 and the first sleeve 113, respectively, allow for medical procedures to be conducted on the exposed portion of the wearer's chest from above if the wearer is in the sitting position. Such a configuration also allows medical tubing, wiring, or other medical devices and components to be routed out of the garment to external machines or devices in a comfortable manner.

Figure 3:
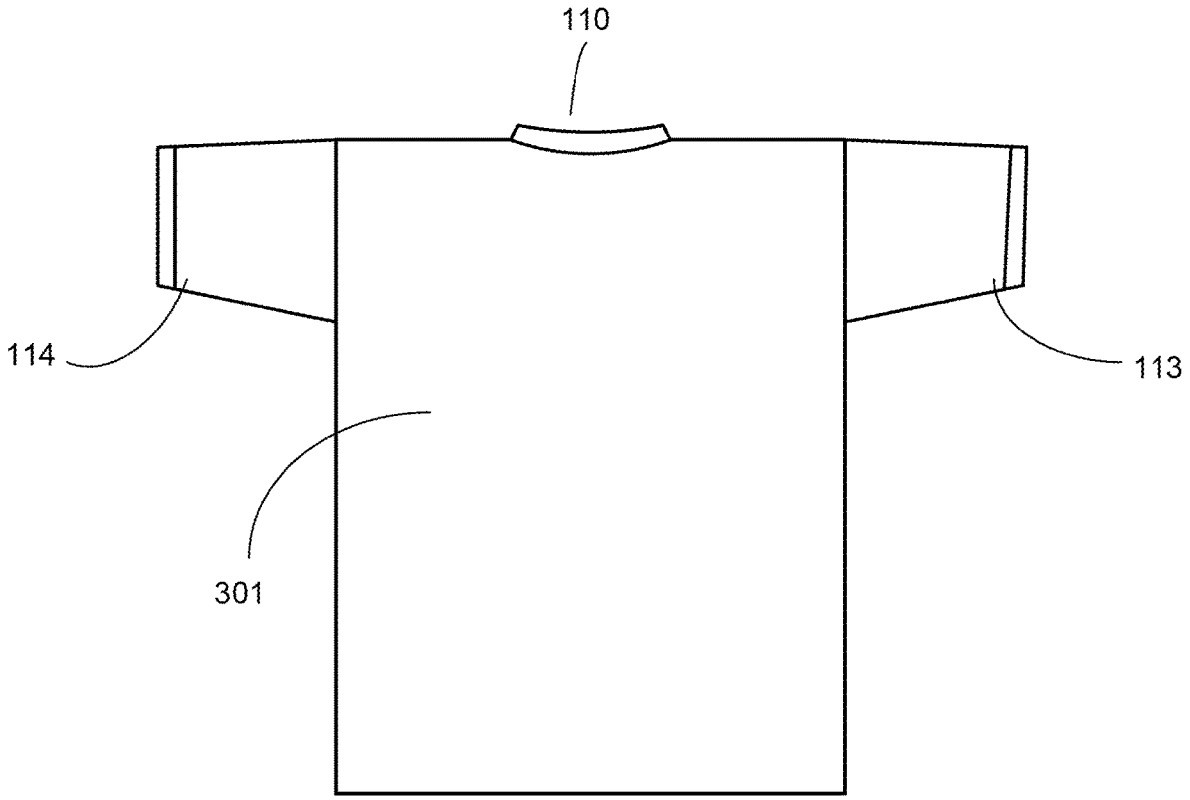
FIG. 3 is a back view of the medical garment of FIG. 1, showing the back portion, the collar, and the back of the sleeves.

Referring to FIG. 3, shown is a back view of the medical garment 100 of FIG. 1, showing the body including an outside surface of the back portion 301, the back view of the collar 110, and the back of the first sleeve 113 and second sleeve 114. Viewed from the back, the medical garment 100 resembles a standard t-shirt whether the flap 120 is in the opened or closed position.

Figure 4:
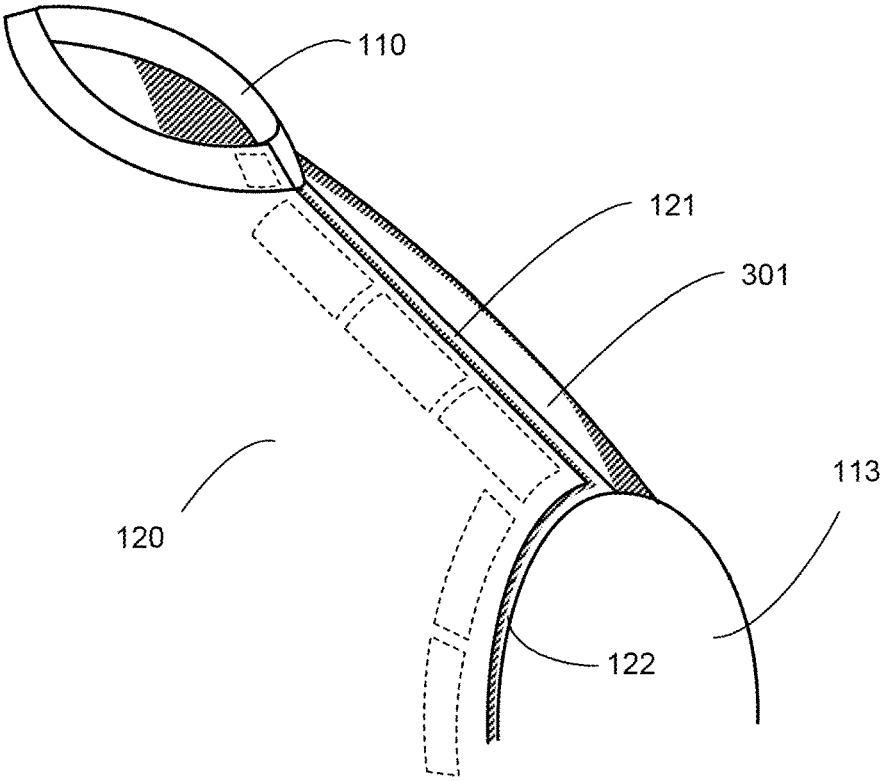
FIG. 4 is perspective view of the medical garment of FIG. 1, showing the flap in the closed position and further showing the first and second partable seams.

Referring to FIG. 4, shown is a perspective view of the medical garment 100 of FIG. 1, showing the flap 120 in the closed position and further showing the first partable seam 121 and second partable seam 122. The first partable seam 121 runs from the collar 110 and along the first shoulder region 111, ending at the top of the first sleeve 113. The second partable seam 122 runs from the top of the first sleeve 113 to the bottom of the first sleeve 113. Fasteners hold the flap 120 closed against the back portion 301 at the first partable seam 121, and at the second partable seam 122. With the flap 120 in the closed position, the first partable seam 121 is aligned with the back portion 301 and the second partable seam 122 is aligned with the first sleeve 113 in such a way that the medical garment 100 outwardly resembles a standard t-shirt, concealing the appearance of the first and second partable seams 121 and 122.

Figure 5:
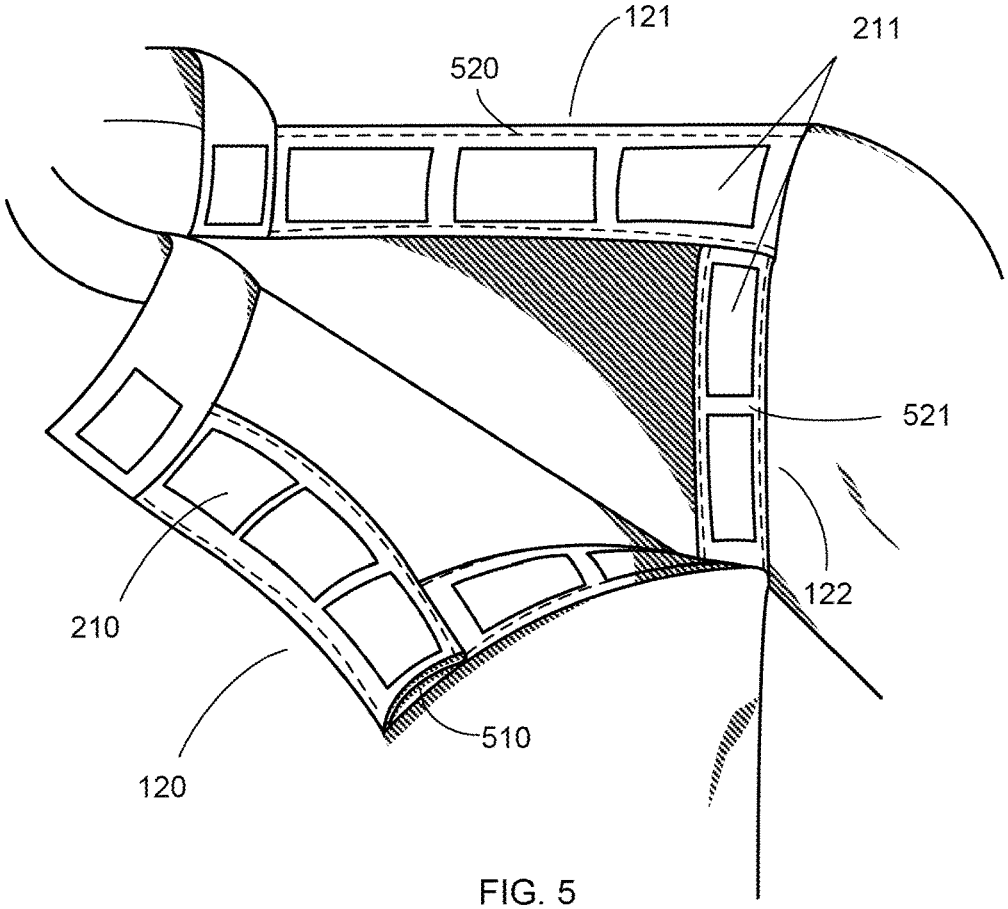
FIG. 5 is a closer view of the open flap of FIG. 2 as seen from the front, showing a first overlap area at the shoulder region and a second overlap area at the sleeve.

FIG. 5 is a closer view of the open flap 120 from FIG. 2 as seen from the front, showing a first overlap area 520 at the first shoulder region 121 and a second overlap area 521 at the first sleeve 113. Fasteners 210 and 211 are affixed to the first overlap area 520 and the second overlap area 521. The areas on the flap 120 corresponding to the first overlap area 520 and the second overlap area 520 have a reinforcement 510, shown in FIG. 5 by a folding over of material from the front portion 101 and sewing the material in place. Likewise, the first overlap area 520 at the shoulder region and second overlap area 521 at the sleeve are reinforced by folding over material from the back portion at the first partable seam 121, and a folding over material from the sleeve at the second partable seam 122. Additional or alternative methods of reinforcing first and second overlap areas 520 and 510 and reinforcement 510 on the flap 120 may also be used, such as the addition of cloth or other material, or the embedding of other material.

Some embodiments include the use of different types of fasteners 210 and 211 to hold the flap 120 in a closed position, including hook and loop fasteners, buttons, clips, or zippers. Also, the length of sleeves or number of sleeves present on the garment can be altered in accordance with alternative embodiments.

Catheter lines and other attachments can be comfortably routed from the wearer's chest to outside the garment by passing the lines through the first partable seam 121 or second partable seam 122. The use of the appropriate fasteners at the first and second partable seams 121 and 122 allows the passage of the catheter lines and attachments even while the flap 120 is in the closed position. In some embodiments, avoiding large, hard fasteners at the first and second partable seams allow a person to comfortably wear the medical garment while lying down or sleeping. The medical garment provides efficiency and comfort for the wearer, in both medical and casual capacities.

For example, the use of hook and loop or button type fasteners is suitable for certain medical procedures and situations, particularly when medical tubing or wiring must pass from the wearer's chest to external equipment. The use of the medical garment would allow such tubing or wiring attached to the wearer's chest to pass through the garment while the flap 120 is in a closed position. However, compared to the use of buttons, hook and loop fasteners would provide more comfort to the wearer when the garment is worn laying down, as the hard buttons may impinge on the wearer's neck, shoulders, and arms.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. A medical garment that resembles a shirt, in that when the medical garment is worn by a person, first and second sleeves of the medical garment are configured to extend to about the person's elbows or wrists, the medical garment is configured to extend down to about the person's waist, the medical garment comprising:

a body comprising a front portion and a back portion connected by one or more non-partable seams, wherein the first and second sleeves are coupled to the front portion and the back portion and wherein the front portion includes one or more partable seams, wherein the body comprises a first intersection of the front portion, the back portion, and the first sleeve and a second intersection of the front portion, the back portion, and the first sleeve, wherein the first intersection is located near an upper portion of the garment and wherein the second intersection is located closer to a lower portion of the garment relative to the first intersection;

wherein each of the one or more partable seams on the front portion of the body comprise:

a zippered opening that extends from a collar area of the medical garment away from the collar area toward the second intersection; and a zipper to close the zippered opening of the partable seam and hold the partable seam in a closed position;

wherein the one or more partable seams are configured to open to expose an area of the person's upper torso;

wherein other than the one or more partable seams, the medical garment is substantially free of openings that would expose the upper torso.

2. The medical garment of claim 1, wherein the body comprises a third intersection of the front portion, the back portion, and the second sleeve and a fourth intersection of the front portion, the back portion, and the second sleeve, wherein the third intersection is located near an upper portion of the garment and wherein the fourth intersection is located closer to a lower portion of the garment relative to the third intersection, wherein a second zippered opening extends from a second collar area toward the fourth intersection.

3. The medical garment of claim 1, wherein when the zippered opening is in an open position, an area of the person's torso is exposed, and when the zippered opening is in the closed position, the area of the person's torso is covered.

4. The medical garment of claim 1, wherein the zippered opening of the medical garment, when open, allows a medical device to be passed therethrough.

5. The medical garment of claim 4, wherein the zippered opening is disposed on the medical garment in a location proximate to a location where the medical device enters the person's body.

6. The medical garment of claim 1, wherein the zippered opening is disposed on the medical garment in a location proximate to a chest area of the medical garment and the chest area of the medical garment is disposed on a chest area of the person when the medical garment is worn.

7. The medical garment of claim 1, wherein use of the medical garment allows a patient to receive a medical device without the patient removing the patient's clothing.

8. A medical garment that resembles a shirt, in that when the medical garment is worn by a person, first and second sleeves of the medical garment are configured to extend to about the person's elbows or wrists, the medical garment is configured to extend down to about the person's waist, and other than one a zippered opening configured to open to expose an area of the person's upper torso, the medical garment is substantially free of openings that would expose the upper torso, the medical garment comprising:

a body comprising a front portion and a back portion connected by a non-partable seam, wherein the first and second sleeves are coupled to the front portion and the back portion, wherein the body comprises a first intersection of the front portion, the back portion, and the first sleeve and a second intersection of the front portion, the back portion, and the first sleeve, wherein the first intersection is located near an upper portion of the garment and wherein the second intersection is located closer to a lower portion of the garment relative to the first intersection, and wherein the front portion includes a partable seam, the partable seam comprising:

a zippered opening that extends from a center area of the front portion laterally toward the second intersection; and a zipper to close the zippered opening of the partable seam and hold the partable seam in a closed position.

9. The medical garment of claim 8, wherein the body comprises a third intersection of the front portion, the back portion, and the second sleeve and a fourth intersection of the front portion, the back portion, and the second sleeve, wherein the third intersection is located near an upper portion of the garment and wherein the fourth intersection is located closer to a lower portion of the garment relative to the third intersection, a second zippered opening extends from the center area on a different portion of the front portion of the body away from the center toward the fourth intersection.

10. The medical garment of claim 8, wherein when the zippered opening is in an open position, an area of the person's torso is exposed, and when the zippered opening is in the closed position, the area of the person's torso is covered.

11. The medical garment of claim 8, wherein the zippered opening of the medical garment, when open, allows a medical device to be passed therethrough.

12. The medical garment of claim 11, wherein the zippered opening is disposed on the medical garment in a location proximate to a location where the medical device enters the person's body.

13. The medical garment of claim 8, wherein the zippered opening is disposed on the medical garment in a location proximate to chest area of the garment and the chest area of the medical garment is disposed on a chest area of the person when the medical garment is worn.

14. A garment, comprising:

a body comprising a front portion and a back portion;

a sleeve coupled to the front portion by at least a portion of a partable seam, and the back portion by at least a portion of a non-partable seam;

a collar at a top portion of the body, the collar defining an opening and having a perimeter; wherein a top partable seam extends: from the opening along a shoulder region at or near the top portion of the body, wherein the partable seam extends from the shoulder region down along a sleeve adjacent region of the front portion, toward a bottom portion of the body; and one or more fasteners configured to hold the partable seam and top partable seam in a closed position and configured to release the partable seam and the top partable seam into an open position such that the partable seam and top partable seam at least partially defines a flap, wherein the flap is configured to open from the collar to the shoulder region, where the flap extends from the collar at least along a top portion of the body to the shoulder region, wherein the flap is configured to open away from the top portion of the body and downward toward the bottom portion of the body, wherein no other partable seam defines the flap, wherein the flap is configured such that opening the flap opens the perimeter of the collar at the top portion of the body; wherein when the garment is worn by a person the sleeve is configured to extend to about the person's elbow or wrist and at least partially surround the person's arm and the bottom portion of the body is configured to extend to about the person's waist, wherein when the partable seam and the top partable seam is in the open position the flap is configured to expose a portion of the person's torso, wherein other than the flap the medical garment has no more than one other flap for exposing an upper torso or arm of the person.

15. The garment of claim 14, wherein the one or more fasteners comprises one or more of a hook-and-loop type fastener, a clip, a button, a zipper, and a clasp.

16. The garment of claim 14, wherein the flap overlaps a portion of the body and an area where the flap overlaps the body is reinforced.

17. The garment of claim 14, wherein the flap of the garment, when open, allows a medical device to be passed therethrough.

18. The garment of claim 14, wherein a size of the flap varies depending on the size of the garment.

19. The garment of claim 14, wherein when the flap is in an open position, an area of the person's torso is exposed, and when the flap is in the closed position, the area of the person's torso is covered.

* * * * *